United States Patent [19]

Mikkelsen

[11] Patent Number: 4,625,776

[45] Date of Patent: Dec. 2, 1986

[54] VENDING MACHINE DELIVERING CUPS CONTAINING FRESHLY MADE BEVERAGES

[75] Inventor: Per W. Mikkelsen, Odense, Denmark

[73] Assignee: Wittenborgs Automatfabriker, Odense, Denmark

[21] Appl. No.: 753,652

[22] Filed: Jul. 10, 1985

[30] Foreign Application Priority Data

Aug. 3, 1984 [DK] Denmark ..... 3778/84

[51] Int. Cl.[4] ..... B65B 3/04

[52] U.S. Cl. ..... 141/83; 141/174

[58] Field of Search ..... 141/129–191, 141/83

[56] References Cited

U.S. PATENT DOCUMENTS 2,391,003 12/1945 Bowman ..... 141/174
3,097,670 7/1963 Berman ..... 141/83

FOREIGN PATENT DOCUMENTS 0036734 3/1981 European Pat. Off. .
2343324 9/1973 Fed. Rep. of Germany .
2813608 3/1978 Fed. Rep. of Germany .
661666 11/1951 United Kingdom .
690324 4/1953 United Kingdom .
907049 10/1962 United Kingdom .
1570410 7/1980 United Kingdom .
2107689 5/1983 United Kingdom .

*Primary Examiner*—Houston S. Bell, Jr.
*Attorney, Agent, or Firm*—Ladas & Parry

[57] ABSTRACT

A vending machine delivering cups containing freshly made beverages and comprising a cup dispenser dispensing empty cups to a filling device (4) receiving each cup during the making process, said vending machine comprising at least one powder dispensing device for an adjustable dispensing of portions of the powder to the cup in the filling device (4), as well as a water feeding device feeding water to the cup with the powder. The filling device (4) comprises a cup holder (46) supporting each cup during the filling in of the individual ingredients of the beverage. This cup holder (46) is capable of weighing the cup and one or more of the added ingredients in sequence so as thereby to regulate the adjustment of the associated dispensing device and the water feeding device as well as to detect whether the contents thereof are about to being used up. Hereby preparing of beverages containing uniform amounts of ingredients, so that the vending machine is capable to deliver freshly made beverages with a uniform quality.

8 Claims, 4 Drawing Figures

VENDING MACHINE DELIVERING CUPS CONTAINING FRESHLY MADE BEVERAGES

FIELD OF THE INVENTION

The invention relates to a vending machine delivering cups containing freshly made beverages and comprising a cup dispenser dispensing empty cups to a filling device receiving each cup during the making process, said vending machine comprising at least one powder dispensing device for an adjustable dispensing of portions of the powder to the cup in the filling device as well as a water feeding device feeding water to the cup with the powder.

BACKGROUND ART

Vending machines delivering cups containing freshly made beverages are known whereby the feeding of the various ingredients such as powder for the preparation of soda or coffee as well as sugar is controlled with respect to amount by adjusting the individual dispensing devices and the water feeding device in such a manner that associated delivery mechanisms are activated upon the adjustment for a constant period of time each time the vending machine is activated for preparing and dispensing a beverage. These These known vending machines do not disclose completely satisfactory results with respect to the composition of the beverage as the amounts dispensed have a tendency to vary to a sometimes unagreeable extent in spite of the adjustment. Consequently a demand exists for a vending machine capable of currently to carry out an adjustment of the dispensed amounts of powder and optionally also water.

SUMMARY OF THE INVENTION

The object of the invention is to provide a vending machine allowing such a current adjustment of the measured amounts contained in a freshly made beverage.

The vending machine according to the invention is characterised in that the filling device comprises a cup holder supporting each cup during the filling in of the individual ingredients of the beverage, said cup holder being capable of weighing the cup and one or more of the added ingredients in sequence so as thereby to regulate the adjustment of the associated dispensing device and the water feeding device as well as to detect whether the contents thereof are about to being used up.

In this manner the vending machine can compensate currently for deviations in the measurements of the amounts in question, said registered measurements being used for controlling the activation mechanisms of the dispensing devices in question. At the same time it is possible to perform an advantageous observation of whether an ingredient is about to being used up. This so-called empty-sensing is is considerably more reliable than the use of known empty-sensors in direct connection with a powder dispensing device where the function of the empty-sensor is unstable on account of problems associated with powder dust. At the same time a centraly empty-sensing is obtained instead of involving an empty-sensor in connection with each powder dispensing device.

According to the invention the cup dispenser may advantageously comprise an axially displaceable ring receiving and supporting the cup during the filling process and being removed by an axial displacement relative to the cup so as to position said cup on a delivery platform after completion of the filling process.

According to a particularly advantageous embodiment of the vending machine according to the invention where the filling device comprises a rotor with a cup-receiving chamber and by means of which a supplied cup is advanced in sequence past one or more powder-dispensing devices and a water feeding device as well as, if disired, a covering mounting station. The vending machine is characterized in that the cup holder is pivotably mounted in connection with a weighing unit adapted to follow the rotor during its rotation.

The cup holder ring may according to the invention be shaped integral with an arm projecting radially from the ring and being hingedly mounted about an axis extending horizontally in the use position at the end opposite the ring, said axis extending perpendicular to the arm, and the cup holder arm extends a radially relative to the axis of rotation of the rotor and is hingedly mounted within the weighing unit on the side opposite the ring diametrally seen relative to the axis of rotation of the rotor, and the arm of the cup holder ring rests on a centrally positioned weighing cell in the weighing unit in the use position. In this manner a particularly simple embodiment of the cup holder with the associated weighing unit is obtained.

The weighing unit and the associated cup holder are according to the invention displaceably mounted about the same fixed shaft as the rotor, the weighing unit being secured on a tubular member which is displaceably connected to the upper end of the fixed shaft and retained against rotation relative to said fixed shaft by means of a pin projecting radially inwards and cooperating with an axially extending slot in the fixed shaft, whereby the portion of the weighing unit which is connected to the cup holder is pivotably mounted relative to the portion which is secured to the tubular member and which carries the weighing cell, and the tubular member comprises an acme thread on the outside which is adapted to cooperate with a circumferential driving wheel with an inner acme thread and which is driven by means of a motor. As a result the weighing unit and the associated cup holder can in a very simple manner be displaced into the desired position and removed from the cup when said cup is to be removed upon completion of the filling process.

According to a particularly simple embodiment of the invention the cup holder is hingedly mounted by a flat spring.

Furthermore according to the invention a level sensor is provided which ensures that the cup holder always position the upper rim of the cup in question at a predetermined level upon the receipt thereof. In this manner the top rim of the cup is always positioned at the same level irrespective of the dimensions of the cup and indeed at a level which is the most practical level for the filling process and the mounting of a cover.

Finally according to the invention the cup holder and the bottom of the cup-receiving chamber in the rotor may be shaped in such a manner that the cup holder and the bottom together form a planar platform-creating surface when the cup holder is lowered into its lowermost position. In this manner the cup can be displaced easily and freely out of the cup-receiving chamber when the filling process is completed and the cup containing a beverage can be delivered to the customer.

BRIEF DESCRIPTION OF DRAWING

The invention will be described below with reference to the accompanying drawing, in which.

DESCRIPTION OF PREFERRED EMBODIMENTS

Figure 1:
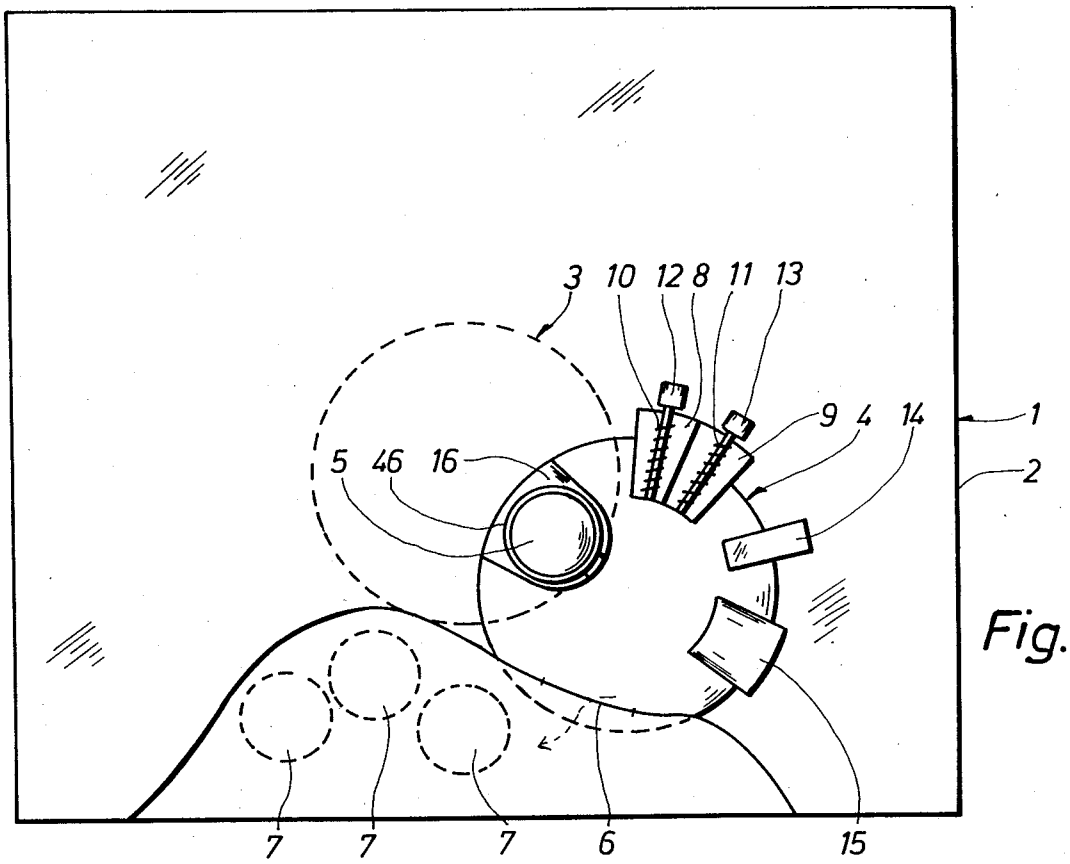
FIG. 1 is a top diagrammatic sectional view through a vending maching delivering completely made beverages in cups, whereby only parts have been included for the sake of clarity.

The vending machine of FIG. 1 is proved with the general reference numeral 1, and according to the preferred embodiment the vending machine is shaped as a cupboard-shaped cabinet 2. A cup dispenser provided with the general reference numeral 3 is situated in the cabinet 2 and delivers cups one by one to a filling device when the vending machine is activated. The filling device is provided with the general reference numeral 4 and ensures during rotation the filling of a cup 5 with a desired beverage. Upon filling the cup is delivered through an opening 6 on the front of the vending machine. Filled cups 7 are shown in FIG. 1 by dotted lines.

The illustrated vending machine is of the type described in Danish patent application No. 4383/81, but may also be of another type in which the cup is filled at activation of the vending machine.

During the rotation of the filling device from the dispensing of the cup 5 at the cup dispenser 3 to the opening 6 on the front of the vending machine, the cup passes below a row of powder dispensing devices 8 and 9, only two appearing from the drawing. These powder dispensing devices comprise in a generally known manner an amount of powder such as coffee, sugar, and powder for preparing soda. Furthermore the powder dispensing devices comprise their respective delivery mechanism which as indicated may be a screw feeder 10 and 11, respectively, driven by their respective motor 12 and 13, respectively. These powder dispensing devices are of a generally known type. Having passed the powder dispensing devices 8 and 9 the cup 5 is positioned below a water feeding device 14 also of a generally known type, and subsequently the cup passes a cover mounting station 15 possibly of the type described in the above Danish patent application.

Figure 2:
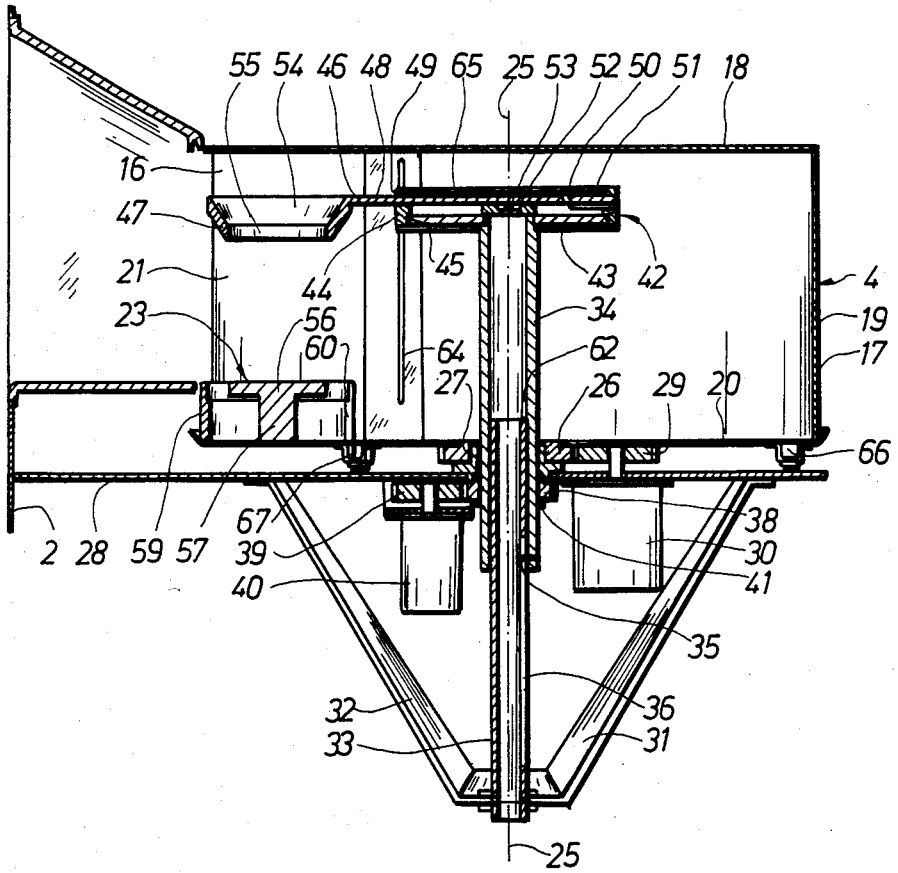
FIG. 2 is a vertical sectional view on a larger scale through the filling device of the vending machine when its cup-receiving chamber opposes the delivery compartment of the vending machine.
Figure 4:
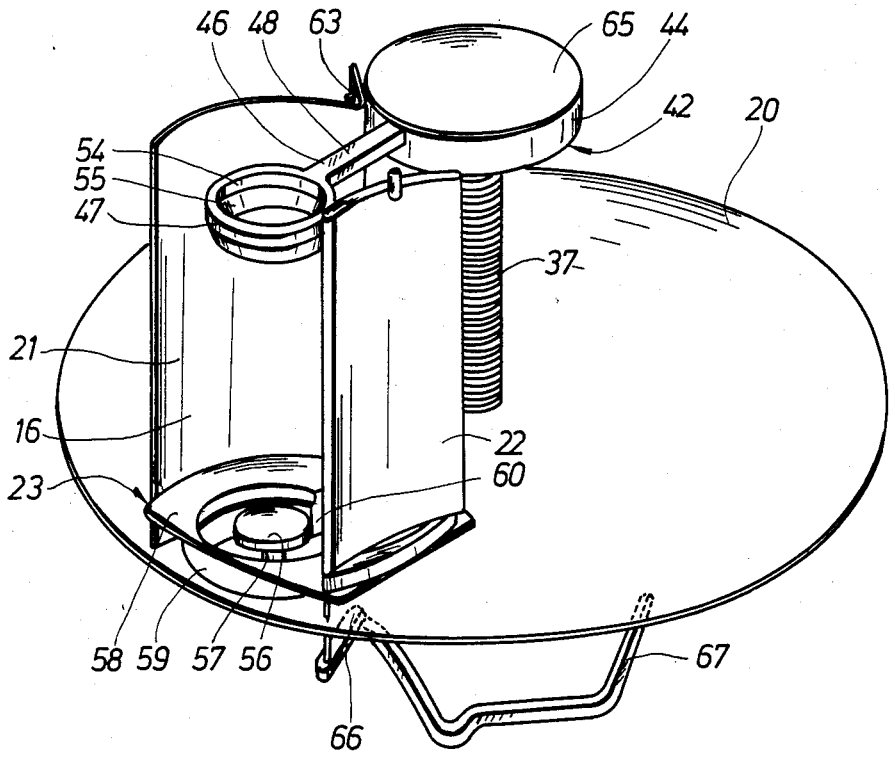
FIG. 4 is a perspective, diagrammatic view of parts of the filling device.

FIG. 2 is a vertical axial sectional view of the filling device 4 extending through the middle of a chamber 16 for receiving a cup 5, cf. FIG. 1, during the filling process. The filling device 4 comprises a rotor 17 with an upper circular, horizontal plate 18, a cylindrical wall 19 associated with said plate, and a lower circular, horizontal plate 20 connected to said wall. The lower plate 20 forms the bottom plate of the rotor. The upper horizontal plate 18 and the cylindrical wall 19 of the rotor 18 comprise recesses allowing passage of a cup in and out of the cup chamber 16. The cup chamber 16 is screened inside the cylindrical wall 19 and the upper horizontal plate 18 of the rotor 17 by means of a wall portion 21 fixed on the bottom plate 20 and a wall portion 22 pivotably mounted on the bottom plate 20, cf. FIG. 4 illustrating the rotor without the cylindrical wall 19 and the upper plate 18. Downwardly the chamber 16 is defined by a bottom provided with the general reference numeral 23 which will be described more detailed below.

The bottom plate 20 of the rotor is pivotably mounted about an axis of rotation 25, the bottom plate being fixedly connected to a gear 26 coaxially about said axis of rotation. The gear 26 is pivotably mounted on a coaxially positioned fixed hub 27 secured to a fixedly mounted bracket plate 28 in turn fixedly mounted in the cabinet 2 of the vending machine. The gear 26 fixed on the bottom plate 20 of the rotor 17 is adapted to cooperate with a driving gear 29 driven by means of a motor 30. Thus the motor 30 is adapted to make the rotor 17 rotate by a suitable activation and thereby to move the cup chamber 16 around along its path during the filling process.

On the underside of the fixed bracket plate 28 a bracket with two legs 31, 32 is mounted, each leg inclining downwards relative to the bracket plate and inwards towards the axis of rotation 25 of the rotor. These bracket legs 31 and 32 support at the bottom a fixed tube 33 extending coaxially with the axes of rotation 25 of the rotor from the bracket legs 31, 32 upwards through the bracket plate 28, the hub 27, and the bottom plate 20 of the rotor, and ending a short distance above said bottom plate 20. A tubular spindle 34 is displaceably mounted about the above tube 33 and extends coaxially upwards into the interior of the rotor 17. The lower end of the tubular spindle is provided with a pin 35 projecting radially inwards. The pin 35 is adapted to cooperate with an axially extending slot 36 in the fixed tube 33, whereby it is ensured that the tubular spindle is prevented from rotating relative to the fixed tube 33.

Figure 3:
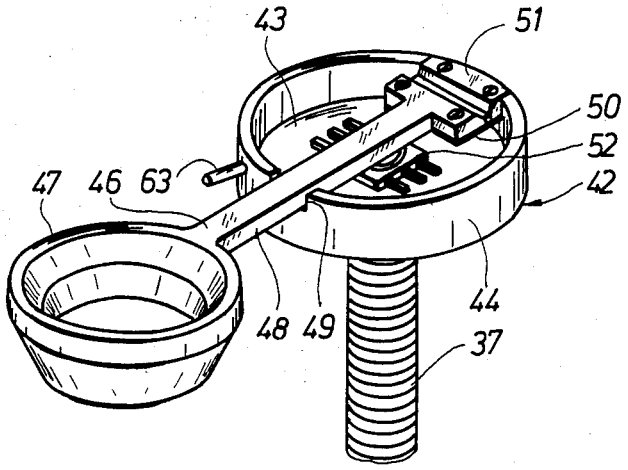
FIG. 3 is a perspective view showing a cup holder ring and an associated weighing unit with the cover removed.

On the outside the spindle 34 is provided with an acme thread 37 diagrammatically indicated in FIGS. 3 and 4. This acme thread is adapted to cooperate with an inner acme thread of a circumferential driving gear 38 cooperating with a gear 39 in turn situated on the output shaft of a motor 40. Thus the motor 40 is adapted to make the spindle 34 be displaced relative to the tube 33 at activation. The driving gear 38 abuts as indicated in FIG. 2 the fixed hub 27 and is kept abutting said hub by means of for instance a rectangular supporting plate 41 with a hole. The plate 41 is fixedly mounted relative to the fixed bracket plate 28 by means of distance pieces situated outside the gear 38 and not shown. The plate 41 may for instance be secured by means of a tube extending coaxially with the fixed tube 33 and the spindle 34 upwards from the bracket legs 31 and 32.

A weighing unit is secured at the upper end of the spindle 34 and is provided with the general reference numeral 42. This weighing unit comprises a bottom 43 fixed on the spindle and a cylindrical wall 44 pivotably mounted relative to said bottom. The cylindrical wall 44 extends coaxially with the axis of rotation 25 of the rotor and comprises at the lower rim facing inwards a circumferential recess 45 cooperating with the outer periphery of the bottom 43 of the weighing unit.

As clearly illustrated in FIG. 3, the pivotably mounted wall 44 of the weighing unit 42 supports a cup holder 46 comprising a cup holder ring 47. As illustrated in FIGS. 2 and 4, the cup holder ring 47 is centrally positioned inside the cup chamber 16 with its axis situated substantially parallel to the axis of rotation of the rotor.

A cup holder arm 48 extends radially from the cup holder ring 47 inwards through a recess 49 in the pivotable wall of the weighing unit 42. From this wall the cup holder arm 48 extends diametrally to the opposite side of the pivotable wall 44, where it is hingedly connected to said wall by means of a flat spring 50. The flat spring 50 extends as shown in a substantially horizontal plane between the end of the cup holder arm 48 oppositve the cup holder ring 47 and a projection 51 projecting inwards on the pivotable wall 44. The cup holder arm 48 rests permanently on a weighing cell 52 in the centre of the weighing unit 42, said weighing cell being fixedly mounted on the bottom 43 of the weighing cell and being of a generally known type. The contact between the cup holder arm 48 and the weighing cell 52 coincides with the axis of rotation of the rotor as the part of the weighing cell abutted by the cup holder arm 48 is formed by a ball-shaped body 53.

As illustrated particularly in FIG. 2, the cup holder ring 47 comprises on the inside two frusto-conical surfaces 54 and 55, respectively having a decreasing vertex angle when seen in a direction from the top and downwards relative to FIG. 2. As a result, the lower frusto-conical surface possesses the same conicity as the cups 5 used in the vending machine at the same time as the diameter of the surface 55 corresponds to an outer diameter on the cup a short distance from the upper rim of the cup. The upper frusto-conical surface 54 forms a funnel facilitating the receiving of a cup passing from the top downwards into the cup chamber 16 when dispensed from a cup dispenser 3.

Besides the cup holder ring is dimensioned in such a manner that when the motor 40 through the spindle 34 has situated the cup holder ring in a lowermost position, the cup holder ring is received in a correspondingly shaped recess in the bottom 23 of the cup chamber 16. Therefore the bottom 23 comprises a central member coaxially situated relative to the cup holder ring 47, said central member comprising a circular, horizontal disk 56 and a central foot 57 extending perpendicular to said disk. The central foot 57 supports the disk 56 on top of the bottom plate 20 of the rotor. The bottom 23 comprises furthermore an outer bottom surface formed by a plate 56 with a through hole situated coaxially with the circular disk 56. The plate 56 levels with the disk 56 on top of the bottom plate 20 and is secured to said bottom plate by means of a cylindrical pipe section 59. At the side facing the axis of rotation 25 both the bottom plate 58 and the cylindrical pipe section 59 comprise a recess 60 receiving the cup holder arm 49 when the cup holder 46 is in the lower position. In addition, the annular slot between the circular disk 56 and the outer bottom plate 56 discloses such inner and outer dimensions that the cup holder ring 47 can be received freely in said slot. In order to ensure that the upper surface of the cup holder 46 levels with the top side of the bottom 23 when the cup holder is situated in its lowermost position by means of the motor 40, the spindle 34 and the weighing unit 42 are adapted to cooperate with a stop means such as for instance a microswitch.

In order to maintain the central position of the cup holder 46 inside the cup chamber 36 with the cup holder ring 47 in the same coaxial position relative to the circular disk 56 of the bottom 23, the pivotable wall 44 of the weighing unit 42 comprises a pin 63 projecting radially outwards and adapted to cooperate with a vertically extending guideway 64. The guideway is shaped in a backwardly bended portion of the fixed wall 21 forming part of the cup chamber 16. This guideway 64 forms simultaneously a carrier for the pivotable wall 44 of the weighing unit and the cup holder 46 connected thereto during the movement of the rotor about its axis of rotation 25.

At the top the weighing unit is closed by a cover 65.

In use a cup 5 is as mentioned received in the cup holder ring 47 adapted to carry the cup freely suspended above the bottom 23 of the cup chamber. Initially, the cup holder 46 is positioned in an uppermost position seen relative to for instance the guideway 64, by means of the motor 40. A cup enters the cup holder 46, and the latter is detected by the associated equipment of the weighing cell, said equipment signaling that the motor 40 should be activated. The motor 40 lowers the weighing unit intil a photocell not shown detects that the rim of the cup is on a predetermined level above the bottom 23 of the cup chamber 16.

As the rotor 17 moves forwards to the various filling devices 8, 9 or to the water feeding device 14 in response to the order given by the customer, the associated equipment of the weighing cell detects the mass of the amount filled in and compares said mass with the mass adjusted in advance. A possible disagreement between the mass filled in and the mass expected results in a correction of the rotation of the screw feeder 10, 11 through the associated equipment of the weighing cell at the next dispensing from the same filling device 8, 9, and a correction of the dispensing time of the water feeding device 14. The delay in time at the fall of the medium fed from the dispensing device to the bottom of the cup implies that it is impossible directly to use the detection of the weighing cell for interrupting the dispensing when the mass adjusted in advance has been achieved. The equipment of the weighing cell may furthermore be adapted to detect when a filling device cannot dispense a sufficiently great amount within a more specific period and consequently must be empty.

The weighing cell 52 used is of a generally known type and a Philips KPZ lOG can suitably be used. The electric equipment used for carrying out the said weighings and guidings of the filling devices are also of a generally known type for which reason they have not been described more detailed. When filled with water at the water feeding device 14 the cup is initially carried past the cover mounting station 15 rolling a cover thereon while the cup passes in a generally known manner. After the cover mounting station 15 the motor 40 ensures that the cup holder 46 is positioned in its lowermost position and subsequently pushes the filled cup outwards through the opening 6 of the vending machine by means of the pivotable wall member 22 of the chamber 16. The pivotable wall 22 of the chamber 16 is activated by means of a cam follower 66 adapted to follow a cam track 67 not described more detailed.

Subsequently the rotor is ready for carrying out another filling operation. During the rotation of the rotor the bottom surface 20 of the rotor is supported by suitable sliding shoes 66 and 67 sliding on top of the fixed bracket plate 28. As mentioned above the cup holder arm is pivotably mounted by means of a flat spring 50. This flat spring 50 has not significant influence on the weighing as it influences the weighing cell all the time by a constant force as a consequence of the movement of the weighing cell at total swinging only corresponds to about 50$\mu$.

The present invention has been described with reference to a preferred embodiment. Other embodiments are, however, also possible without departing from the spirit and the scope of the invention as set forth in the appended claims.

I claim:

1. A vending machine for delivering cups containing freshly made beverages comprising a cup dispenser for dispensing empty cups; a filling device for receiving said empty cups during the process said beverages are made; a powder dispensing device, said powder dispensing device able to adjust to amount of powder dispensed to the cup in said filling device; a water feeding device, said water feeding device feeding water into said cups in said filling device, said filling device comprised of a cup holder supporting each cup during the filling in of each of the ingredients of the beverage, said cup holder mounted to a weighing unit for weighing the cup and at least one of the added ingredients of the beverage in sequence and regulating the delivery of the powder dispensing device and water feeding devices, said cup holder detecting when the ingredients thereof are about to be used up.

2. A vending machine as claimed in claim 1 wherein the cup holder (46) comprises an axially displaceable ring (47) receiving and supporting the cup (5) during the filling process and being removed by an axial displacement relative to the cup (5) so as to position said cup on a delivery platform (23) after completion of the filling process.

3. A vending machine as claimed in claim 2, and whereby the filling device comprises a rotor (17) with a cup-receiving chamber (16), and by means of which a supplied cup (5) is advanced in sequence past one or more powder-dispensing devices (8, 9) and a water feeding device (14), as well as, if desired, a cover mounting station (15), wherein the cup holder (47) is pivotably mounted in connection with a weighing unit (42) adapted to follow the rotor (17) during its rotation.

4. A vending machine as claimed in claim 3, wherein the cup holder ring (47) is shaped integral with an arm (48) projecting radially from the ring and being hingedly mounted about an axis extending horizontally in the use position at the end opposite the ring (47), said axis extending perpendicular to the arm (48), and that the cup holder arm (48) extends a radially relative to the axis of rotation (25) of the rotor (17) and is hingedly mounted within the weighing unit (42) on the side opposite the ring diametrally seen relative to the axis of rotation of the rotor, and that the arm (48) of the cup holder ring rests on a centrally positioned weighing cell (52) in the weighing unit (42) in the use position.

5. A vending machine as claimed in claim 4, wherein the weighing unit (42) and the associated cup holder (46) are displaceably mounted about the same fixed shaft (33) as the rotor, the weighing unit being secured on a tubular member (34) which is displaceably connected to the upper end of the fixed shaft (33) and retained against rotation relative to said fixed shaft (33) by means of a pin (35) projecting radially inwards and cooperating with an axially extending slot (36) in the fixed shaft (33), whereby the portion (44) of the weighing unit (42) which is connected to the cup holder (46) is pivotably mounted relative to the portion (43) which is secured to the tubular member (34) and which carries the weighing cell (42), and that the tubular member (34) comprises an acme thread (37) on the outside which is adapted to cooperate with a circumferential driving wheel (38) with an inner acme thread and which is driven by means of a motor (40).

6. A vending machine as claimed in claim 4, wherein the cup holder (46) is hingedly mounted by a flat spring (50).

7. A vending machine as claimed in claim 4, wherein a level sensor is provided which ensures that the cup holder always position the upper rim of the cup in question at a predetermined level upon the receipt thereof.

8. A vending machine as claimed in claim 5, wherein the cup holder (46) and the bottom (23) of the cup-receiving chamber (16) in the rotor (17) are shaped in such a manner that the cup holder (46) and the bottom (23) together form a planar platform-creating surface when the cup holder (46) is lowered into its lowermost position.

* * * * *